US005535879A

United States Patent [19]

Appleton

[11] Patent Number: 5,535,879

[45] Date of Patent: Jul. 16, 1996

[54] SYSTEM FOR PACKAGING CONTAINERS

[76] Inventor: Arthur J. Appleton, 61 Eagle Lake La. #31, San Ramon, Calif. 94583

[21] Appl. No.: 372,398

[22] Filed: Jan. 13, 1995

[51] Int. Cl.[6] ..... B65D 75/00

[52] U.S. Cl. ..... 206/150; 206/144; 206/151; 294/87.2

[58] Field of Search ..... 206/150, 144, 206/145, 142, 143, 151, 158, 160, 162, 428; 294/87.2, 149, 152

[56] References Cited

U.S. PATENT DOCUMENTS

| | | | |
|---|---|---|---|
| 2,359,297 | 10/1944 | Brogden | 229/16 |
| 3,232,422 | 2/1966 | Whyte | 206/56 |
| 3,327,845 | 6/1967 | Hasselhoff | 206/65 |
| 3,348,674 | 10/1967 | Poupitch | 206/65 |
| 3,392,876 | 7/1968 | Allred | 220/115 |
| 3,454,156 | 7/1969 | Chatten | 206/65 |
| 3,792,562 | 2/1974 | Gillian | 206/162 X |
| 4,033,457 | 7/1977 | Weaver | 206/150 X |
| 4,232,807 | 11/1980 | Beier et al. | 224/45 |
| 4,518,081 | 5/1985 | de Lorosiere | 206/158 |
| 4,523,676 | 6/1985 | Borrash | 206/150 |
| 4,688,367 | 8/1987 | Bonkowski | 53/398 |
| 5,038,928 | 8/1991 | Marco et al. | 206/162 |
| 5,092,456 | 3/1992 | Straub | 206/144 |

*Primary Examiner*—Paul T. Sewell
*Assistant Examiner*—Tara L. Laster
*Attorney, Agent, or Firm*—Bielen, Peterson & Lampe

[57] ABSTRACT

A system for packaging at least a pair of containers each having an openable portion such as a flip top. A first holder is utilized with respect to the first container and includes a first member for at least partially surrounding the first container openable portion. A second holder is also provided and includes a second member for at least partially surrounding the second container openable portion. The first and second holders are connected to one another in a separably sealing manner to form an abutment between the openable portions of the first and second containers. A handle extends from the connected first and second holders.

8 Claims, 2 Drawing Sheets

SYSTEM FOR PACKAGING CONTAINERS

BACKGROUND OF THE INVENTION

The present invention relates to a novel and useful system for packaging a multiplicity of containers for easy access and in a sanitary configuration.

Containers such as cans and bottles are often sold in groups such as four-packs, six-packs, and the like. In the past, many packaging arrangements have been devised to hold such containers together as a saleable unit.

U.S. Pat. Nos. 2,359,297, 3,392,876, and 3,327,845 describe carrying containers in which packages are wrapped around the exterior of the can and are formed with a strap to carry the package in a convenient manner.

U.S. Pat. No. 3,232,422 describes an article carrier in which a receptacle having a multiplicity of openings is pressed over the ends of a six-pack of cans and fitted with a handle for carrying the same.

U.S. Pat. No. 4,688,367 describes a cover for soft drink cans in which a plastic-like material is formed over the openable ends of the cans in order to seal the same.

U.S. Pat. No. 3,454,156 and 4,232,807 show stacked cans which are held in abutment by a peripheral band which extends down the same and is fitted with a handle for carrying.

U.S. Pat. No. 3,348,674 describes a container carrier and package in which a plurality of bead engaging caps are shown and which are further bound together in abutment by a base portion. A handle is connected to the base portion for carrying of the same.

Although many of the prior packaging schemes are capable of carrying containers such as cans or bottles without danger of the containers coming loose during handling, such packaging schemes are not efficient in use of material. In addition, many packaging schemes require elaborate tooling in order to mass produce the same for use in distribution network.

A packaging system for multiple containers which is of adequate strength to carry multiple containers and yet make very efficient use of material would be a notable advance in the food and beverage industry.

SUMMARY OF THE INVENTION

In accordance with the present invention a novel and useful system for packaging multiple containers is herein provided.

The container system of the present invention utilizes a first holder for a first container. The first holder includes a plate having a member or band for at least partially surrounding the first openable portion of the container. That is to say, the first member would fit in the bead below the end of the can that may be opened for use, or the neck of a bottle. A second holder is also similarly configured in that a second plate having a member at least partially surrounds the second container openable portion.

First and second holders may be integrally formed and further include connection means for attaching the first holder to the second holder. By such connection, the first and second cans are oriented such that the openable portions lie in opposition to one another, i.e,. in abutment. The connection means further essentially removably or separably seals the first and second members to one another about the peripheral bands to maintain the abutment relationship between the openable portions of the first and second containers. Thus, the first and second members may be peeled or separated from one another at a later time, which will be discussed hereinafter. The positioning of the first and second containers in abutment at each container's openable portion prevents dirt, moisture, and other undesirable contaminants from gathering at or about the openable portions of each of the first and second containers.

A handle may also be connected to the separably connected first and second holders in order to carry the first and second containers conveniently. A handle may be formed as a tab or closed loop connected to the first holder and another tab or closed loop connected to the second holder. The first and second closed loops may also be removably sealed to one another to serve as the connection means. Moreover, the first and second holders may include weakened or frangible portions to permit separation of the first holder from the second holder at a position opposite to the first and second loops. Consequently, the first and second containers may be transported as a unit and may be separated by the user for use at a later time.

The system of the present invention may also be employed to carry four, six, eight, or any number of containers in the same manner. That is to say, the first holder may include a first plurality of holders and the second holder may include a second plurality of holders. The first and second plurality of holders may be a number of collars, which formed on a plate, each capable of at least partially surrounding a container for the purpose of supporting the container thereto. The plates of the first multiplicity of holders and the second multiplicity of holders may be attached to one another by connection means such that a plurality of pairs of cans are held in abutment, much in the same manner as the first and second holder with respect to a single pair of cans. Again, the plates of the first and second plurality of holders include a separable or frangible portion in order to split the package for storage and/or use after transportation.

It may be apparent that a novel and useful system for packaging a multiplicity of containers is herein provided.

It is therefore an object of the present invention to provide a system for packaging a multiplicity of containers which makes very efficient use of material while possessing sufficient strength to hold containers during transportation from a manufacturing facility to a distribution facility.

Another object of the present invention is to provide a system for packaging a multiplicity of containers which permits the user to retrieve a single container or to divide the container holder portion of the system into two parts for storage and use.

A further object of the present invention is to provide a system for packaging a multiplicity of containers which are capable of positioning the openable portion of each container in close abutment to prevent contamination by solid materials, moisture, and other contaminants.

Another object of the present invention is to provide a system for packaging a multiplicity of containers which includes a splitable handle portion that is integrally formed with the container holding portion of the system of the present invention and continues functioning as a handle when the handle and holder portions of the system are split into two separate packages.

The invention possesses other objects and advantages which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments thereof which should be taken in conjunction with hereinabove described drawings.

Figure 1:
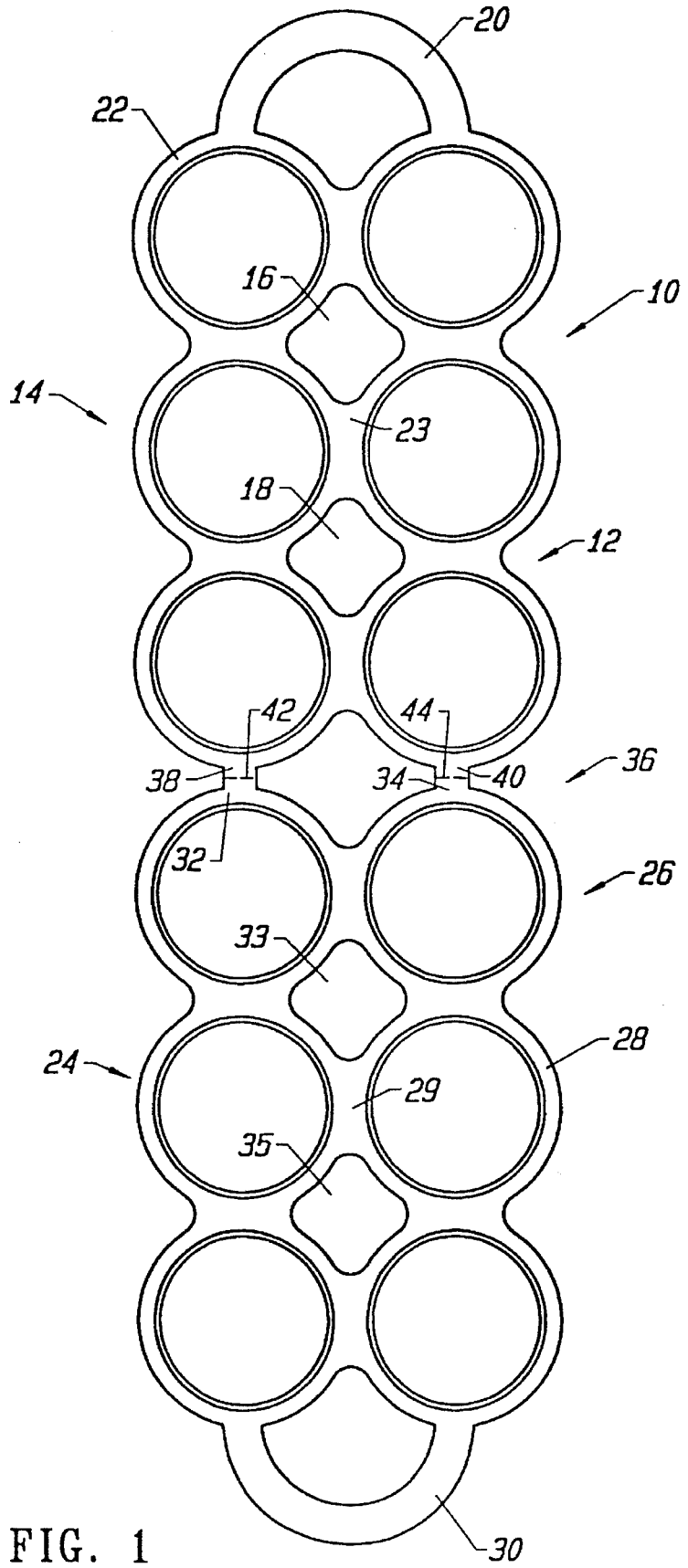
FIG. 1 is a top plan view of the packaging system of the present invention prior to insertion of containers.

The invention as a whole is shown in the drawings by reference character 10. The packaging system 10 includes as one of its elements a first element in the form of an element or plate 12 for holding at least one container and preferably a multiplicity of containers. With reference to FIG. 1, it may be observed that plate 12 possesses a plurality of circular openings 14 each of which is capable of holding a container such as a metallic can. Openings 16 and 18 represent removed material from plate 12 and also serve to provide finger openings in the manipulation of the package for the containers in the system 10 of the present invention, which will be discussed in greater detail hereinafter. Outer perimeter band and central member 23 form plurality of circular openings 14. Closed loop or tab 20 extends from the outer perimeter band 22.

Second element or plate 24, FIG. 1 is similarly constructed to first plate 12, having a plurality of openings 26 for holding a multiplicity of metallic cans, formed by outer perimeter band 28 and central member 29. Outer perimeter band 28 terminates in a closed loop or tab 30 at one end and a pair of flaps 32 and 34. Again, openings 33 and 35 represent removed material for the sake of conserving material in the manufacture of system 10.

Connection means 36 is illustrated in FIG. 1 where flaps 32 and 34 of outer perimeter band 28 of second plate 24 link or connect to flaps 38 and 40 of outer perimeter band 22 of first plate 12. Frangible or weakened portions 42 and 44 permit the separation of first plate 12 from second plate 24 upon the application of a separating force therebetween.

Figure 3A:
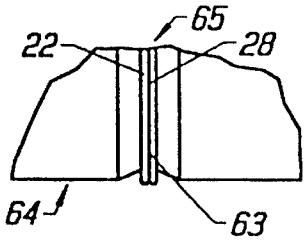
FIG. 3A is a detail depicting the complete sealing of the plate portions of the present invention about the periphery of such plate portions.
Figure 2:
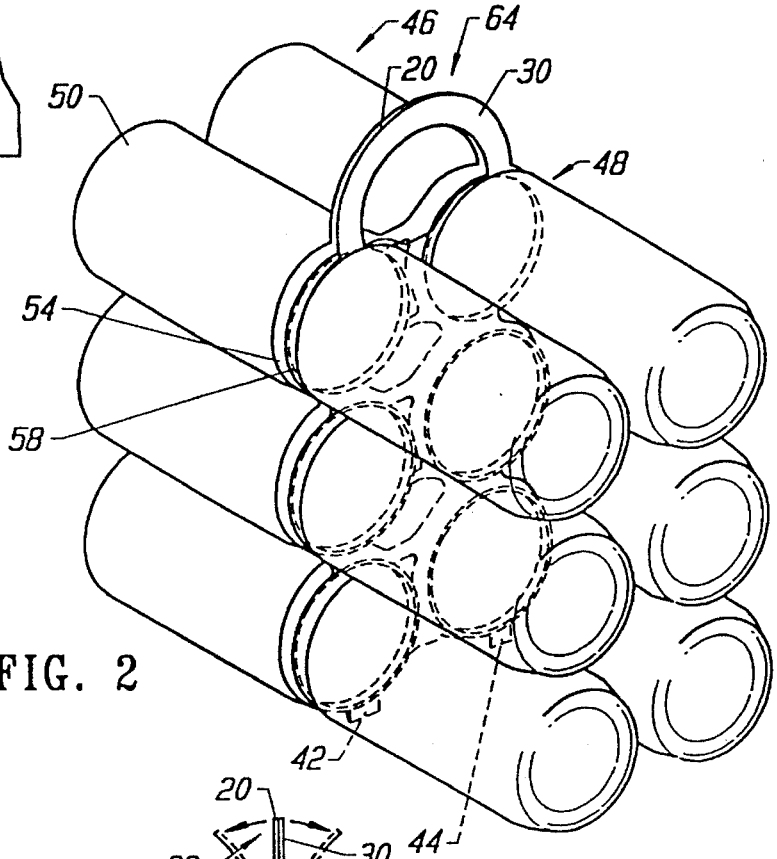
FIG. 2 is a top right perspective view of the packaging system of the present invention in which twelve aluminum cans have been held together, six cans being in abutment with six other cans.

FIG. 2 represents the employment of first and second plates 12 and 24 to support a plurality of containers 46. Thus, plurality of openings 14 and plurality of openings 26 of first and second plates 12 and 24, respectively, provide a multiplicity of holders 48 for plurality of containers 46. That is to say, each holder of multiplicity of holders 48 is sized to slip over the groove found in the top of a typical aluminum can, in the embodiment depicted in FIGS. 2 and 3. For example, with reference to FIG. 3, can 50 is depicted with top or openable portion 52 oriented to the right. Holder 54 is shown as being placed over groove or indent 56 of can 50. It should be noted that holder 54 in the form of a circular opening is sized to fit snugly in groove 56 and may exert pressure thereat in certain cases. This fit may be achieved by providing plates 12 and 24 with a degree of elasticity, heat shrinking plates 12 and 24, or other techniques known in the art. In any case, holder 54 of plate 12 firmly grips or collars can 50. Similarly, holder 58 of plate 24 collars or grips can 60 such that openable portion or top 62 faces to the left on FIG. 3. Thus, openable portion 52 of can 50 and openable portion 62 of can 60 are in abutment. In most cases, openable portions 52 and 62 of cans 50 and 60, respectively, essentially provide a seal which obviates the entry of solid matter, moisture, and the like to the openable portions or tops 52 and 62, thereof. In other words, tops 52 and 62 of cans 50 and 60 remain clean during shipment of system 10. In certain cases, outer perimeter band or element 22 of plate 24 and outer perimeter band or element 28 of plate 24 may be sealed to one another about most of the perimeter of system 10, FIG. 3A. Seal line 63 represents such sealing means 65, in this regard.

Figure 3:
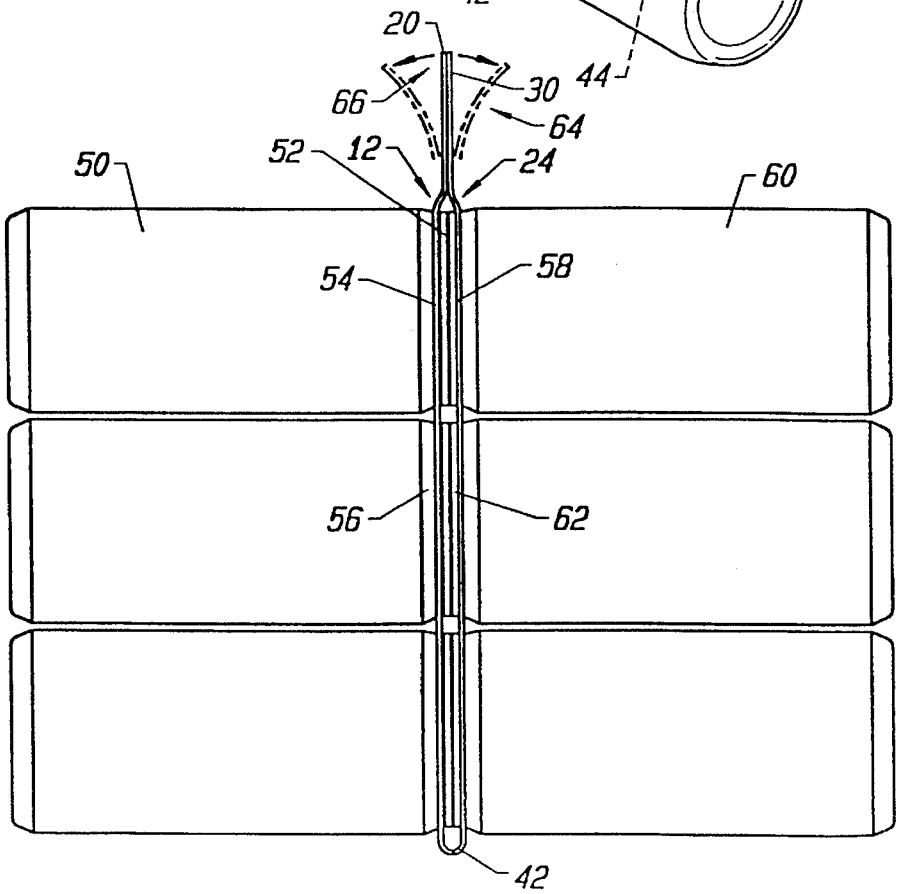
FIG. 3 is a side elevational view of the container system of FIG. 2 illustrating the separable handle and holder portions as well as the weakened portions between the holders to effect complete separation of the same.

Closed loops 20 and 30 of plates 12 and 24 are sealed to one another by any suitable fastening means 66 such as gluing, heat annealing, sonic welding, and the like. Thus, loops 20 and 30 form a handle 64 for system 10. With reference to FIG. 3, it may be observed that handle 64 is separably or removably sealed to permit the splitting of loops 20 and 30 when opening container system 10, directional arrows 66. Thus, the removable connection between loops 20 and 30 further serves as connections means 36.

With further reference to FIGS. 2 and 3, it may be observed that frangible parts 42 and 44 are capable of separating from one another forming a pair of six-packs when handle loops 20 and 30 are separated, coincidentally with the breaking of frangible portions 42 and 44.

In operation, a plurality of containers 46 are placed in multiplicity of holders 48 formed from the circular openings 14 of first plate 12 and circular openings 26 of second plate 24. Such circular openings are formed by the outer perimeter bands 22 and central member 23 of first plate 12, and outer perimeter band 28 and central element 29 of second plate 24. First plate is then rotated about frangible portions 42 and 44 toward second plate 24. Closed loops 20 and 30 are then sealed together to form handle 64 and orient opposing containers of plurality of containers 46 into abutment. Exemplar cans 50 and 60 represent such orientation on FIG. 3. It should be noted that the system of the present invention may be employed to hold as few as two cans or containers in abutment with one another, such as cans 50 and 60, or a greater number, such as the twelve cans depicted in the embodiment shown in FIGS. 1–3. During transportation, each pair of cans in abutment are protected against debris entering the top or openable portion of each particular can. When used, each can may be individually removed from system 10. Moreover, the loops 20 and 30 of handle portion 64 may be forced apart, and frangible portions 42 and 44 may be broken to form a pair of container packs, two six-packs as shown in FIGS. 1–3. In the case where plates 12 and 24 are sealed at their peripheries, loops 20 and 30 would initiate the separation between plates 12 and 24. Again, plates 12 and 24 and containers held thereto would be completely separated from one another, i.e., into two six-packs. Loops 20 and 30 would still serve as handles for each container holding section formed by plates 12 and 24.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A system for packaging a multiplicity of containers including at least a first container and at least a second container, each container having an openable portion; comprising:

a. a first holder for said first container said first holder including a first member for at least partially surrounding said first container openable portion;

b. a second holder for said second container, said second holder including a second member for at least partially surrounding said second container openable portion, said openable portions of said first and second containers being oriented in opposition to one another;

c. connection means for attaching said first holder to said second holder, said connection means further essentially sealing said first and second members to one another to permit subsequent separation and to form an abutment between said openable portions of said first and second containers; and d. a handle connected to said separably sealed first and second holders, said handle including a first tab and a second tab, said first tab being linked to said first holder, said second tab being linked to said second holder, and fastening means for removably connecting said first tab to said second tab.

2. The system of claim 1 in which said first and second members of said first and second holders comprises collars which at least partially surround said openable portions of said first and second containers.

3. The system of claim 1 in which said connection means integrally forms said first holder to said second holder.

4. The system of claim 3 which additionally comprises a weakened part between said integral first and second holders permitting said first and second holders to separate at said weakened parts.

5. The system of claim 4 in which said weakened part includes first and second frangible portions spaced from one another.

6. A system for packaging a plurality of containers each having an openable portion in a first group and a plurality of containers, each having an openable portion in a second group comprising:

a. a first plurality of holders for said first group of containers, each of said plurality of holders for said first group of containers including a member for at least partially surrounding each container of said first group;

b. a second plurality of holders for said second group of containers each of said plurality of holders for said second group of containers including a member for at least partially surrounding each container of said second group, said openable portions of said plurality of containers in said first group being oriented in opposition to said openable portions of said plurality of containers in said second group;

c. connection means for attaching said first plurality of holders to said second plurality of holders, to permit subsequent separation of said first plurality of holders from said second plurality of holders, and to form at least one abutment between a pair of openable portions of the first and second group of containers; and d. a handle connected to said first and second plurality of holders, said handle including a first tab and a second tab, said first tab being linked to said first plurality of holders, said second tab being linked to said second plurality of holders.

7. The system of claim 6 in which said connection means further essentially seals each member of said first plurality of holders to each member of said second plurality of holders.

8. The system of claim 6 in which said first plurality of holders includes a first holder unit and said second plurality of holders include a second holder unit, said first holder unit being removably connected to said second holder unit.

* * * * *